US005256131A

United States Patent [19]

Owens et al.

[11] Patent Number: 5,256,131

[45] Date of Patent: Oct. 26, 1993

[54] BEVERAGE COOLING WRAP METHOD OF MANUFACTURE

[75] Inventors: Claudia R. Owens, West Jordan; Dennis Thurman, Salt Lake City, both of Utah

[73] Assignee: Practical Products, Inc., Salt Lake City, Utah

[21] Appl. No.: 931,209

[22] Filed: Aug. 17, 1992

[51] Int. Cl.[5] ..... B31B 13/00

[52] U.S. Cl. ..... 493/374; 493/243; 493/297; 493/379; 220/903

[58] Field of Search ..... 493/210, 243, 244, 297, 493/374, 379, 383, 384, 386, 921, 918; 220/903

[56] References Cited

U.S. PATENT DOCUMENTS 5,109,588 5/1992 Hewlett et al. ..... 220/903

*Primary Examiner*—Bruce M. Kisliuk
*Assistant Examiner*—Elleen Morgan
*Attorney, Agent, or Firm*—Thorpe, North & Western

[57] ABSTRACT

A method of manufacturing a beverage cooling or heating wrap for keeping a beverage cool or warm, as desired, comprises steps of providing a generally rectangular strip of material, superimposing and attaching a piece of insulation to the strip, twice folding the strip and insulation to create a three-layered bundle, securing the longitudinal edges of the bundle, inverting the bundle about the axis of one of the folds, inverting the bundle about the axis of the other fold, and securing fasteners to the bundle.

16 Claims, 2 Drawing Sheets

BEVERAGE COOLING WRAP METHOD OF MANUFACTURE

BACKGROUND OF THE INVENTION

This invention relates to an improved method of manufacturing a beverage cooling or warming wrap. More particularly, this invention relates to an improved method of manufacturing a flexible cooling or warming wrap that contains a layer of insulation, a channel for holding a chillable or warmable blanket, and fasteners for fastening the wrap around a beverage container that is to be kept cool or warm.

Insulated holders of beverage containers of several types have been described previously. For example, U.S. Pat. No. 4,540,661 describes a beverage insulator primarily made of foam insulation that can be stored flat or opened to receive a beverage can or other container. Knit sleeves (U.S. Pat. No. 4,514,995), insulated jackets (U.S. Pat. Nos. 4,401,245 and 4,293,015), and insulated wraps (U.S. Pat. No. 4,282,279) have also been described.

Of particular relevance to the instant invention is the method of Hewlett, described in U.S. Pat. No. 5,109,588, for making a beverage cooler of the wrap-around type. The steps in making the cooler include making a jacket having inner and outer pockets with entrance openings for each pocket. A blanket of insulation is inserted into the outer pocket. A "VELCRO" fastener is then secured to the outer pocket so that the entrance to the outer pocket is permanently sealed. The other part of the fastener is secured to the other end and other side of the jacket so that when the jacket is wrapped around a beverage container the fastener parts may be connected. A blanket of heat-absorbing material may be insert into the inner pocket.

When forming the jacket, three pieces (inner, central, and outer) of generally rectangular jacket material are cut so that they have generally the same widths. The outer and central pieces have the same lengths, but the inner piece is somewhat shorter. These pieces are then superimposed on one another before sewing them together around the periphery of the layered pieces. This sewing step forms two pockets, one open, because the shorter inner piece is spaced inwardly and not sewn closed on one side, and the other closed, because it is sewn on all four sides. An opening in the closed, outer pocket is formed by cutting a slit in the outer layer of jacket material. Through this slit the insulation material is inserted. Since the insulation material is somewhat wider than the slit, the insulation material must be compressed while slipping it through the slit. The insulation material then must be manipulated into proper position. A "VELCRO" fastener is then sewn over the slit to permanently close the opening and enclose the insulation material in the outer pocket.

OBJECTS AND SUMMARY OF THE INVENTION

It is an object of the present invention to reduce the number of pieces of material that are needed in manufacturing a beverage cooling or warming wrap.

Another object of the invention is to eliminate the difficulty of aligning and securing multiple layers of material in manufacturing a beverage cooling or warming wrap containing multiple layers.

It is another object of the invention to eliminate the need to cut a slit in a beverage cooling or warming wrap for inserting insulation material.

Still another object of the invention is to eliminate the need to seal a pocket in a beverage cooling or warming wrap into which insulation material is inserted.

These and other objects may be realized by a method of manufacturing a beverage cooling or warming wrap comprising steps of providing a generally rectangular strip of material having a width about the same as the height of a beverage container, superimposing a generally rectangular piece of insulation that is narrower than the strip and about as long as the circumference of a beverage container so that an end of the strip and of the piece of insulation are near each other and the longitudinal sides of the strip and piece of insulation are proximal, attaching the piece of insulation to the strip, twice folding the strip to create a three-layered bundle, securing the longitudinal edges of the bundle, inverting the bundle about one of the folds, inverting the bundle again about the other fold, and attaching fasteners for securing the wrap around a beverage container.

DETAILED DESCRIPTION OF THE INVENTION

Figure 1:
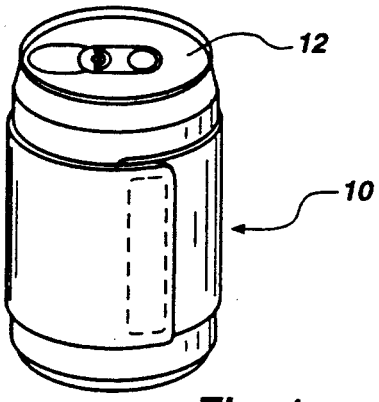
FIG. 1 is a perspective view of a beverage cooling wrap fastened around a beverage container.

The invention described herein is an improved method of manufacturing a beverage cooling or warming wrap 10 (FIG. 1). The wrap 10 is flexible for being wrapped around a beverage container 12 and contains a layer of insulation and a channel into which a layer of heat absorbing or heat radiating material may be placed. The wrap 10 keeps a beverage cool or warm, as desired, for a longer time than would be the case without the wrap in place.

Figure 2:
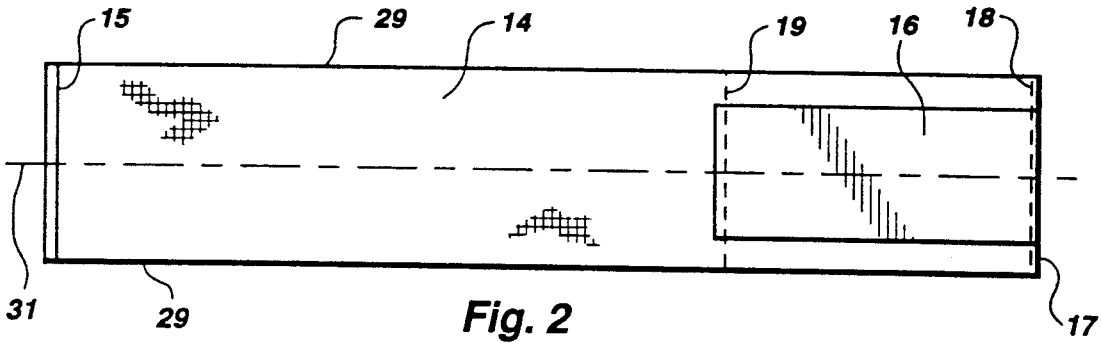
FIG. 2 is a top view of a strip of material with a piece of insulation superimposed and secured, in accordance with the present invention.

As shown in FIG. 2, the process of manufacturing the wrap 10 begins with a generally rectangular piece of fabric 14 that is somewhat narrower than the height of a beverage container 12 that is to be kept cool or warm and is long enough that the completed wrap 10 will encircle the beverage container 12 with enough overlap so that the ends can be fastened together to hold the wrap 10 in place. The fabric is preferably composed of a durable material such as nylon, rayon, cotton, or the like. A hem 15 is preferably placed in one end of the fabric 14 with the tag end of the hem 15 facing up. Other types of finishing procedures could be used, besides hemming, to prevent unraveling of the fabric and such procedures are contemplated as within the scope of the invention. A generally rectangular piece of insulation material 16 is then superimposed on the fabric 14 so that an end of the insulation 16 is near the unhemmed end 17 of the fabric 14. The side of the fabric 14 upon which the insulation 16 is superimposed is conveniently termed the inner side 20 of the fabric 14, and the opposite side of the fabric 14 is the outer side 22, i.e. the side that will be showing in the finished wrap 10. The width of the insulation 16 should be slightly less than the width of the fabric 14 and the insulation 16 should be centered from side to side on the fabric. The insulation 16 is then secured in place, such as with stitches 18 and 19. Other methods of securing the insulation could be used without departing from the scope of the invention.

Figure 3:
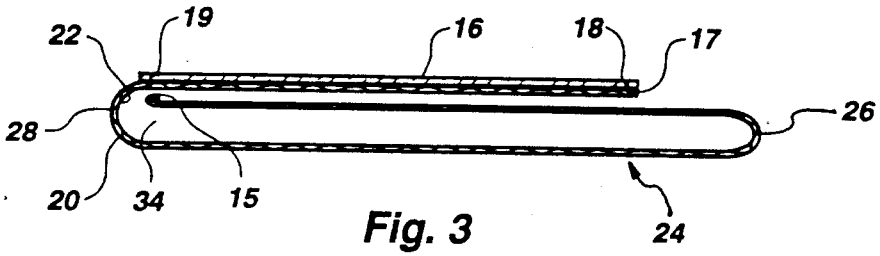
FIG. 3 is a longitudinal section of the strip of material and insulation of FIG. 2 after folding into a bundle in accordance with the present invention.
Figure 4:
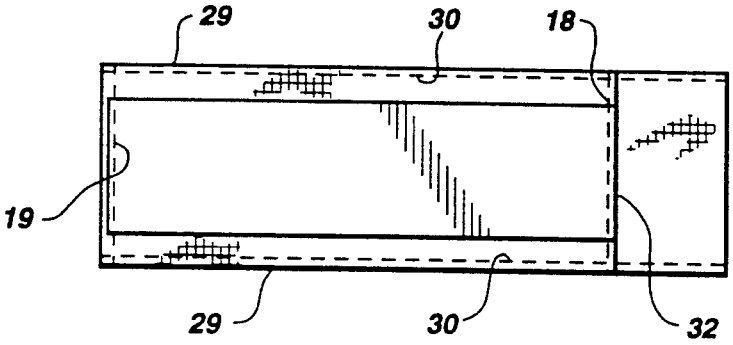
FIG. 4 is a top view of the bundle of FIG. 3 after securing the longitudinal edges, in accordance with the present invention.

The fabric 14 is then folded twice lengthwise to form a three-layered bundle 24 as depicted in FIG. 3. The insulation 16 is on the exterior of the bundle 24 and the hem 15 is on the middle layer of the bundle 24. A convenient method of realizing this folding step is to place the fabric 14 with the inner side 20 face down. Then, the hem 15 is grasped and pulled upwardly and toward the unhemmed end 17 until about the hem-proximal one-third of the fabric is overlaying the remainder of the fabric. This action forms a first fold 26 that is perpendicular to the longitudinal edges 29 or linear axis 31 of the strip. Next, the unhemmed end 17 is grasped and pulled upwardly and toward the first fold 26 until the unhemmed end 17 is slightly recessed from the first fold 26. This action forms a second fold 28, also perpendicular to the longitudinal edges 29 or linear axis 31 of the strip. Then, this folded bundle 24, which is about one-third the length of the unfolded strip, is secured along the longitudinal edges 29 of the bundle 24, such as with stitches 30 (see FIG. 4). It should be recognized that there are a variety of ways that the fabric 14 could be handled and yet result in a correctly folded bundle 24. These alternative manipulations are considered within the scope of the invention.

The steps involved in making a correctly folded bundle 24 may be viewed from another perspective. As before, the strip 14 of fabric of appropriate width and length is provided such that the finished wrap will encircle and may be fastened around a beverage container. A piece of insulation 16 slightly narrower than the strip 14, and about as long at the circumference of a beverage container is superimposed on the strip 14 so that an end of the insulation 16 is near an end 17 of the strip 14 and the longitudinal edges of the insulation 16 and of the strip 14 are proximal. The insulation 16 is then attached to the strip 14, preferably by sewing the insulation 16 and the strip 14 together. This results in a strip 14 with insulated and uninsulated portions. Next, the uninsulated portion is folded approximately in half so that the fold 26 thus created is perpendicular to the longitudinal edges 29 of the strip 14. Then, the insulated portion is folded over the two layers of uninsulated fabric to form a three-layered bundle 24. This second fold is also perpendicular to the longitudinal edges 29 of the strip 14 and the insulation 16 is not folded in the process, although the second fold is near the junction of the insulated and uninsulated portions. The uninsulated portion of the strip 14, thus, comprises an exterior layer and the interior layer of the bundle, and the insulated portion forms the other exterior layer of the bundle 24 with the insulation on the exterior face of the bundle 24. The free end of the uninsulated portion is on the interior layer of the bundle 24. The longitudinal edges 29 of the bundle 24 are then secured, preferably by sewing through the three layers. Thus, a correctly folded and secured bundle 24 is formed.

Figure 5:
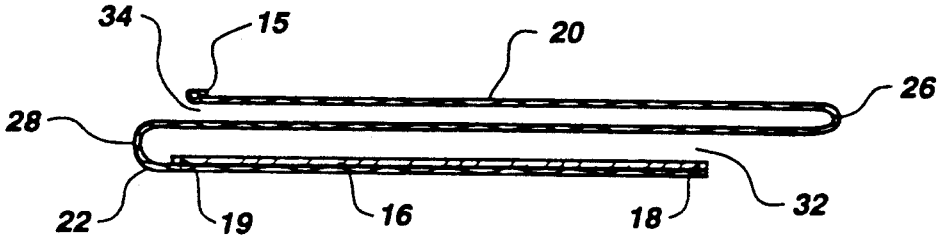
FIG. 5 is a longitudinal section of the bundle of FIG. 4 after a first inversion of the bundle in accordance with the present invention.

At this stage of the process, an opening 32 to the inside of the bundle 24, proximal to the unhemmed end 17, has been created because the longitudinal edges 29 have been sewn together but the unhemmed end 17 has not been secured to another layer of fabric 14. The outer side 22 of the fabric 14 at the second fold 28, which happens to be in the interior of the bundle 24 at this stage of the process (see FIG. 3), is pushed or pulled through the opening 32. This movement is continued until the entire bundle 24 is inverted, the result of which is shown in FIG. 5. The result of this inversion is to invert the second fold 28 and leave the first fold 26 as it was originally. In other words, the second fold is the axis about which the bundle is inverted.

At this point, the opening 32 proximal to the unhemmed end 17 is still visible on the exterior of the bundle 24. Also, a second opening 34 to the interior of the bundle 24 has been made visible proximal to the hem 15. This hem-proximal opening 34 was present previously, of course, but was hidden in the interior of the bundle 24 before inversion of the second fold 28 (see FIG. 3).

The next step in the process is to invert the bundle about the axis of the first fold 26, similar to the manner is which the bundle was previously inverted about the axis of the second fold 28. The first fold 26 is pushed or pulled through the hem-proximal opening 3 until the first fold 26 is completely inverted and only the outer side 22 of the fabric 14 is showing and the opening 32 proximal to the unhemmed end 17 is hidden from view in the interior of the bundle 24 (FIG. 6).

Figure 7:
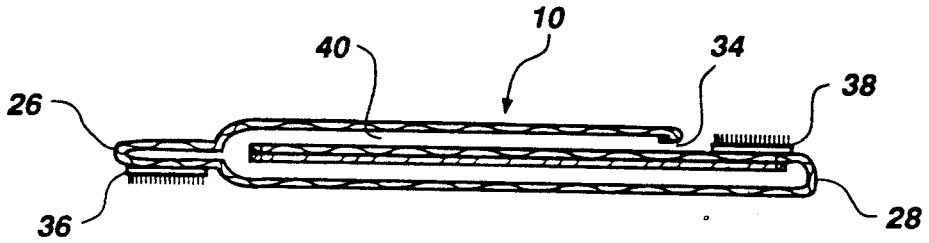
FIG. 7 is a longitudinal section of the beverage cooling wrap after the fasteners have been secured, in accordance with the present invention.
Figure 8:
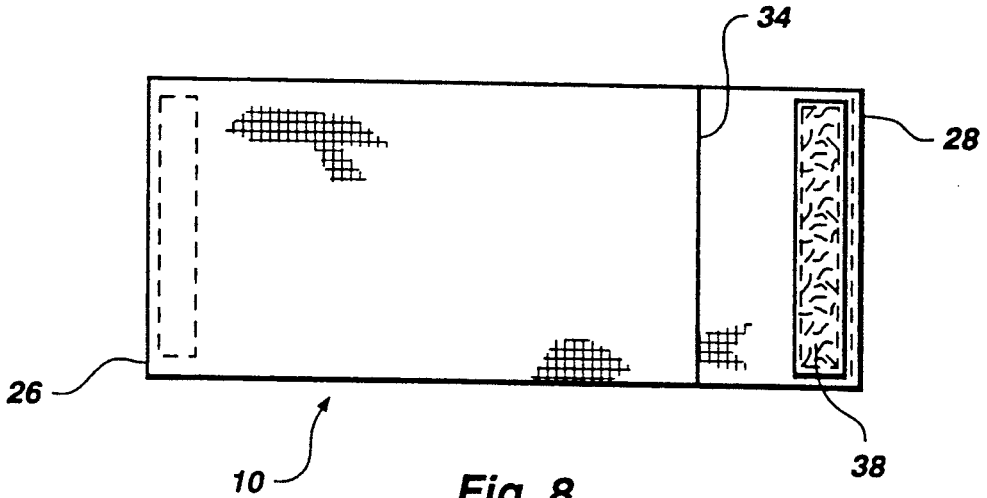
FIG. 8 is a top view of the beverage cooling wrap of FIG. 7.

Finally, fasteners 36 and 38 are attached to the bundle 24 near folds 26 and 28, respectively, to complete fabrication of the wrap 10 (FIGS. 7 and 8). In a preferred embodiment of the invention these fasteners 36 and 38 are hook and pile ("VELCRO") fasteners. Other types of fasteners could be used to achieve the desired results. The hook and pile fasteners 36 and 38 are preferably secured on opposite sides of the wrap 10 so that when the wrap is placed around a beverage container 12, such as a can as shown in FIG. 1, the fasteners 36 and 38 may be connected to hold the wrap 10 in place around the container 12.

Figure 6:
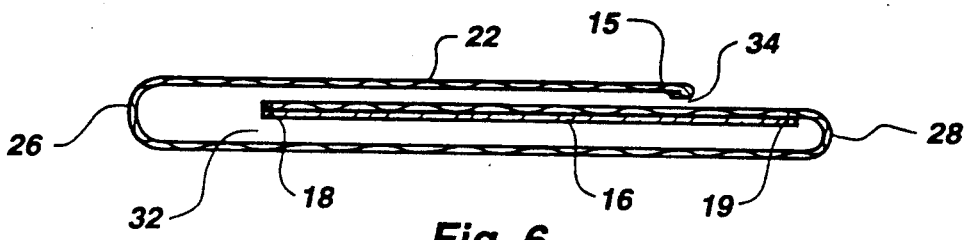
FIG. 6 is a longitudinal section of the bundle of FIG. 5 after a second inversion in accordance with the present invention.

In the completed wrap 10, only opening 34 is present on the exterior of the wrap 10, because opening 32 is hidden in the interior of the wrap 10 (best seen in FIGS. 6 and 7). Opening 32 is never completely closed in the process of making the wrap. Inadvertently, it may be closed partially when fastener 36 is secured, however.

Opening 34 is the entrance to a channel 40 into which a layer of heat absorbing or heat radiating material may preferably be inserted. This heat absorbing material is preferably of a type that may be chilled without losing its flexibility. However, even materials that lose their flexibility upon being chilled could be used. For example, a covering could be constructed with a plurality of transversely extending compartments into which the heat absorbing material would be placed. Each compartment of the covering would be separated by a flexible region. Thus, when the heat absorbing material was chilled and became inflexible, the flexible regions connecting each compartment would permit wrapping of the layer around a beverage container. Of course, the wrap 10 is designed so that the layer of heat absorbing or heat radiating material may be removed from the channel 40, chilled by a refrigeration device or heated by a heating device, and replaced in the channel 40 when a person desires to keep a beverage cool or warm. The wrap with the chilled layer of heat absorbing material, or with the layer of warmed heat radiating material, in the channel 40 is then wrapped around the beverage container and secured in place by the fasteners 36 and 38.

When placed in a warm environment, a chilled beverage absorbs heat from the environment. With the wrap in place around a container holding a chilled beverage, the beverage loses heat to the chilled heat-absorbing layer of the wrap. The heat-absorbing layer absorbs heat from the beverage and also from the environment. However, absorption of heat from the environment is slowed by the layer of insulation in the wrap. The net result is the beverage stays cool for longer than it would have without the wrap in place. Conversely, a layer of heat radiating material keeps a beverage warm for longer than would be the case without the wrap in place.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

We claim:

1. A method of manufacturing a flexible beverage cooling or warming wrap that may be wrapped around a beverage container for keeping a beverage cool or warm, comprising the steps of:

(a) providing a generally rectangular strip of material having a linear axis and inner and outer sides, two longitudinal edges, and first and second ends, wherein the width of the strip is about the same as the height of a beverage container and the length of the strip is sufficient so that the completed wrap will encircle a beverage container;

(b) superimposing a generally rectangular piece of insulation, having an end, two longitudinal edges, a width slightly less than the width of the strip, and a length about equal to the circumference of a beverage container, on the inner side of the strip so that the end of the piece of insulation is near the first end of the strip and the longitudinal edges of the piece of insulation are proximal to the longitudinal edges of the strip;

(c) attaching the insulation to the strip;

(d) folding the strip perpendicularly to the linear axis at a first fold, proximal to the second end, and at a second fold, proximal to the first end, so that a bundle having three layers of strip material (two exterior layers and an interior layer) is realized, wherein the length of the bundle is about one-third that of the strip, no part of the outer side of the material is facing outwardly, the first end is on an exterior layer of the bundle, and the second end is on the interior layer of the bundle;

(e) securing the bundle along the longitudinal edges thereof, so that the two exterior layers and the interior layer are bound together, thus creating a first end-proximal opening on the exterior of the bundle and a second end-proximal opening hidden in the interior of the bundle;

(f) inverting the bundle about the axis of the second fold and slipping the bundle through the first end-proximal opening, wherein the second end-proximal opening appears on the exterior of the bundle after the inversion is completed;

(g) inverting the bundle about the axis of the first fold and slipping the bundle through the second end-proximal opening; and (h) attaching fasteners to the product of step (g) so that the completed wrap may encircle a beverage container and be fastened in place.

2. The method according to claim 1 further comprising a preliminary step of treating the strip such that the fabric at the second end is inhibited from unraveling.

3. The method according to claim 2 wherein the preliminary treating step comprises sewing a hem into the second end of the strip.

4. The method according to claim 1 wherein step (c) comprises sewing the piece of insulation to the strip.

5. The method according to claim 1 wherein step (e) comprises securing the longitudinal edges of the bundle by sewing stitches along said edges.

6. The method according to claim 1 wherein step (h) comprises attaching hook and pile fasteners to the product of step (g).

7. The method according to claim 1 wherein step (h) comprises attaching fasteners to the product of step (g) by sewing.

8. The method according to claim 1 wherein step (h) comprises sewing hook and pile fasteners to the product of step (g).

9. A method of manufacturing a flexible beverage cooling or warming wrap that may be wrapped around a beverage container for keeping a beverage cool or warm, comprising the steps of:

(a) providing a generally rectangular strip of material having a linear axis, two longitudinal edges, and first and second ends, wherein the width of the strip is about the same as the height of a beverage container and the length of the strip is sufficient so that the completed wrap will encircle a beverage container;

(b) superimposing a generally rectangular piece of insulation, having an end, two longitudinal edges, a width slightly less than the width of the strip, and a length about equal to the circumference of a beverage container, on the strip so that the end of the piece of insulation is near the first end of the strip and the longitudinal edges of the piece of insulation are proximal to the longitudinal edges of the strip, thereby forming insulated and uninsulated portions of the strip, respectively;

(c) attaching the insulation to the strip;

(d) folding the strip perpendicularly to the linear axis at a first fold, near the middle of the uninsulated portion, and at a second fold, near the junction of the insulated and uninsulated portions, so that a bundle having three layers of strip material (two exterior layers and an interior layer) is realized, wherein the piece of insulation is unfolded and is on the exterior of the bundle, and the second end is on the interior layer of the bundle;

(e) securing the bundle along the longitudinal edges thereof, so that the two exterior layers and the interior layer are bound together, thus creating a first end-proximal opening on the exterior of the bundle and a second end-proximal opening hidden in the interior of the bundle;

(f) inverting the bundle about the axis of the second fold and slipping the bundle through the first end-proximal opening, wherein the second end-proximal opening appears on the exterior of the bundle after the inversion is completed;

(g) inverting the bundle about the axis of the first fold and slipping the bundle through the second end-proximal opening; and (h) attaching fasteners to the product of step (g) so that the completed wrap may encircle a beverage container and be fastened in place.

10. The method according to claim 9 further comprising a preliminary step of treating the strip such that the fabric at the second end is inhibited from unraveling.

11. The method according to claim 10 wherein the preliminary treating step comprises sewing a hem into the second end of the strip.

12. The method according to claim 9 wherein step (c) comprises sewing the piece of insulation to the strip.

13. The method according to claim 9 wherein step (e) comprises securing the longitudinal edges of the bundle by sewing stitches along said edges.

14. The method according to claim 9 wherein step (h) comprises attaching hook and pile fasteners to the product of step (g).

15. The method according to claim 9 wherein step (h) comprises attaching fasteners to the product of step (g) by sewing.

16. The method according to claim 9 wherein step (h) comprises sewing hook and pile fasteners to the product of step (g).

* * * * *